US008728408B2

(12) United States Patent
Strzelczyk

(10) Patent No.: US 8,728,408 B2
(45) Date of Patent: May 20, 2014

(54) NOZZLE ASSEMBLY FOR MOUNTING IN MECHANICAL OR ELECTRONIC PIPETTE

(75) Inventor: Tomasz Strzelczyk, Warsaw (PL)

(73) Assignee: PZ HTL SPOLKA AKCYJNA, Warsaw (PL)

( * ) Notice: Subject to any disclaimer, the term of this patent is extended or adjusted under 35 U.S.C. 154(b) by 284 days.

(21) Appl. No.: 13/266,153

(22) PCT Filed: Apr. 22, 2010

(86) PCT No.: PCT/PL2010/000030
§ 371 (c)(1),
(2), (4) Date: Oct. 25, 2011

(87) PCT Pub. No.: WO2010/126386
PCT Pub. Date: Nov. 4, 2010

(65) Prior Publication Data

US 2012/0039768 A1 Feb. 16, 2012

(30) Foreign Application Priority Data

Apr. 30, 2009 (PL) ..... 387926

(51) Int. Cl.
*B01L 3/02* (2006.01)

(52) U.S. Cl.
USPC ..... 422/501; 422/516; 422/521; 73/864.13; 73/864.14; 73/864.16

(58) Field of Classification Search
USPC ..... 422/501, 516, 521–522; 73/864.13, 73/864.16–864.18, 864.14
See application file for complete search history.

(56) References Cited

U.S. PATENT DOCUMENTS

| | | | | |
|---|---|---|---|---|
| 3,732,735 | A | 5/1973 | Cohen | |
| 4,054,062 | A | 10/1977 | Branham | |
| 4,466,298 | A | 8/1984 | Tervamaki et al. | |
| 6,627,160 | B2 | 9/2003 | Wanner | |
| 2008/0223108 | A1 * | 9/2008 | Kobayashi et al. | 73/1.74 |

OTHER PUBLICATIONS

International Search Report for International Application No. PCT/PL2010/000030, Dated Aug. 13, 2010.

* cited by examiner

*Primary Examiner* — Jan Ludlow
(74) *Attorney, Agent, or Firm* — Pearne & Gordon LLP

(57) ABSTRACT

The nozzle (3) is in its lower part formed respectively for receiving a pipette exchangeable tip (19) and is in its upper part releasably connected with the holder (2). In the holder (2) a pressure sleeve (6) is placed as being slidably borne in the holder (2). The pressure sleeve (6) is via a pressure sub-assembly seated in the holder (2) pressed to the sealing means placed between the pressure sleeve (6) and the nozzle (3). The plunger (1) is slidably borne in the pressure sleeve (6) and in the pressure sub-assembly. Due to this, leakproofness of the plunger (1) in the nozzle (3), which is indispensable for a correct and reliable pipette operation, is provided in PIPETTING, ADJUSTMENT or CALIBRATION MODES of the pipette. Simultaneously, in MAINTENANCE MODE of the pipette the sealing means automatically slide out from an abutting surface (2*c*) of the holder (2).

15 Claims, 5 Drawing Sheets

NOZZLE ASSEMBLY FOR MOUNTING IN MECHANICAL OR ELECTRONIC PIPETTE

TECHNICAL FIELD

The invention relates to a nozzle assembly for mounting in a mechanical or an electronic pipette.

BACKGROUND ART

From the state of art nozzle assemblies are known for mounting in a handle of a pipette either mechanical or electronic and for cooperation with other mechanisms realizing different functions in the pipette, including a pipette exchangeable tip ejection mechanism and a drawing up and discharging mechanism of pre-set values of a liquid volume.

Many known nozzle assemblies comprise a one-piece nozzle which lower part is shaped respectively, preferably conically, for receiving exchangeable tips and which upper part is mounted in a pipette handle. Inside the nozzle a plunger is slidably mounted. The plunger is coupled with a pipetting rod and further with a push-button of the drawing up and discharging mechanism. For ensuring a correct operation of the pipette and for drawing up or discharging by the pipette repeatable, proper and intended volume values of a liquid, the nozzle assemblies comprise technical means which seal the plunger in the nozzle. In case of the one-piece nozzle, sealing means are situated inside the pipette nozzle in the vicinity of, the most often, the end of the lower part of the nozzle. An access to the sealing means which require cyclic maintenance is difficult in the known nozzle assemblies with the one-piece nozzle.

Effectiveness of a sealing function of the plunger sealing means in the nozzle of the nozzle assembly in the course of different pipette modes, especially in PIPETTING MODE, ADJUSTMENT MODE and CALIBRATION MODE, is a critical issue for correctness of the whole pipette operation. Another important issue for a pipette user is an accessibility to the sealing means to perform necessary maintenance activities in MAINTENANCE MODE of the pipette.

From the patent application No. U.S. Ser. No. 10/239,725 that has been published under No. US 2003/0101831 A1, the nozzle assembly for mounting in a pipette handle is known, which nozzle assembly comprises a nozzle two-piece body consisting of the upper part in the form of the holder and the lower part in the form of the nozzle. The holder and the nozzle are coupled detachably, preferably by means of a screwed connection. In the nozzle two-piece body a plunger is slidably mounted. The plunger cooperates via engaging means with a pipetting rod of a pipette drawing up and discharging mechanism, which is placed in the pipette handle. Between the body pieces i.e between the holder and the nozzle, sealing means are arranged, which are in contact with the holder, the nozzle and the plunger and are compressed between the holder and the nozzle.

In the nozzle assembly disclosed in the publication No. US 2003/0101831 A1, a pressure of sealing means to a nozzle abutting surface and to a plunger working part is realized by means of a releasable connection, preferably a thread connection, between a nozzle and a nozzle holder, and is exerted as a result of a compression of the sealing means between the nozzle abutting surface, the holder abutting surface and the plunger working part. The technical means which serve to exert a proper pressure force are, in case of the screwed connection between the nozzle and the holder, a nozzle external thread and a nozzle holder internal thread. As a result, the pressure force is dependent on dimensions and working tolerances of the nozzle and the nozzle holder. For obtaining a desired value of the pressure force of the sealing means in the form of a sealing ring to the nozzle, to the nozzle holder and to the plunger, the nozzle and the nozzle holder have to be made under a high technological regime so that their dimensions are contained in the accurately determined tolerances.

In this known nozzle assembly, the pressure force of the sealing means to the nozzle, to the holder and to the plunger depends on the manner of coupling the nozzle with the holder, and in the embodiment illustrated the pressure force depends on a degree of screwing the nozzle into the holder. In the case when the nozzle is screwed into the holder improperly or when the nozzle becomes loose as a result of an incorrect operating of the pipette, a leakproof condition between the plunger working part and the nozzle, which is necessary for the correct pipette operation, will not be met.

The manner of mounting the sealing means in the nozzle assembly, which is known from the publication No. US 2003/0101831 A1, makes it impossible to change a type of the sealing means applied and described in this document and further to apply the other type of the sealing means.

In the nozzle assembly of such a structure, after disengagement of the nozzle from the holder in MAINTENANCE MODE of the pipette, the sealing means remain stationary in relation to the plunger and the holder, and are not slid outside automatically from the holder abutting surface, and thus for the maintenance of the sealing means an user has to draw manually the sealing means outside the holder by pressing a pipetting push-button of the pipette and by knocking or shaking with the pipette.

DISCLOSURE OF INVENTION

An object of the present invention is to provide a nozzle assembly of a structure guaranteeing a required leakproofness of a plunger in a nozzle in PIPETTING, ADJUSTMENT or CALIBRATION MODES of a pipette and, simultaneously, the structure enabling the very easy access to sealing means in MAINTENANCE MODE of the pipette.

The next object of the invention is to provide the nozzle assembly of the structure enabling application of many types of the sealing means to seal a plunger working part in the nozzle.

The object of the invention is also to provide the nozzle assembly which eliminates a danger of a loss of the leakproofness of the plunger working part in relation to the nozzle as a result of, for example, unintended incorrect mounting the nozzle in the holder or as a result of the nozzle slackening in the course of the pipette operating.

The next object of the invention is to provide the nozzle assembly with a possibility of a pressure force adjustment of the sealing means to the nozzle and to the plunger working part, and the pressure force adjustment independent on a force arising in a releasable coupling between the nozzle and the nozzle holder.

Further object of the invention is to provide the nozzle assembly with the structure of an advanced operational reliability and an advanced pipette life by reducing a risk of a damage of individual structure elements of the nozzle assembly, which elements are important for the correct operation of the pipette. The risk of the damage is especially present in MAINTENANCE MODE when it is necessary for the user to disassemble completely the nozzle assembly and to detach the mentioned structure elements, and especially the plunger in the pipettes designed for aspiration of small values of the liquid volume.

Additionally, the nozzle assembly should provide a possibility of a continuous observation of all its structure elements as well as their mutual arrangement in MAINTENANCE MODE of the pipette.

Moreover, the structure of the nozzle assembly according to the invention should provide technological and economic advantages for reducing costs of a final product i.e. the pipette, and what is of a great importance for products designed for a wide laboratory and medical use.

The aimed objects have been achieved in the nozzle assembly according to the present invention as presented below.

A nozzle assembly for mounting in a mechanical or an electronic pipette, according to the present invention, comprises:

a two-piece body consisting of a nozzle and a holder;

a plunger cooperating via engaging means with a pipetting rod of a drawing up and discharging mechanism of a pipette, the drawing up and discharging mechanism being placed in a handle of the pipette; and sealing means for sealing the plunger in the nozzle assembly;

wherein the nozzle is in its lower part shaped respectively for receiving a pipette exchangeable tip and is in its upper part releasably connected with the holder;

and whereas said nozzle assembly for ensuring leakproofness of the plunger in the nozzle in PIPETTING, ADJUSTMENT or CALIBRATION MODES of the pipette and for enabling automatic sliding out the sealing means from a holder abutting surface in MAINTENANCE MODE of the pipette has in the holder a slidably borne in it a pressure sleeve which is pressed via a pressure sub-assembly mounted in the holder to the sealing means placed between the pressure sleeve and the nozzle;

the plunger being slidably borne in the pressure sleeve and in the pressure sub-assembly.

Preferably, the pressure sub-assembly comprises a pressure spring, a locking sleeve and a cap which is removably mounted in the holder.

Preferably, the cap is coupled by a thread connection with the holder.

Preferably, the cap has ribs on its external surface, which are formed to facilitate a grip and to improve rigidity of the cap.

Preferably, the nozzle is in its upper part coupled by a thread connection with the holder.

Preferably, the sealing means comprise a gasket and a sealing ring.

Preferably, on the plunger and in cooperation with the pressure sub-assembly a pipetting spring is mounted for cooperation with the pipetting rod of the drawing up and discharging mechanism of the mechanical pipette.

Preferably, the pipetting spring is mounted between a flange of the plunger and the locking sleeve of the pressure sub-assembly, wherein the flange of the plunger abuts its upper surface against an abutting surface of the cap.

Preferably, the nozzle assembly has an ejection assembly of a pipette exchangeable tip ejection mechanism, which is mounted on the nozzle assembly body.

Preferably, the ejection assembly of the pipette exchangeable tip ejection mechanism comprises a sleeve, upper and lower washers, a spring, an ejector, whereas the sleeve is slidably borne on the holder onto which an ejector spring is mounted between and by means of the upper and lower washers and, whereas the ejector is removably connected with the sleeve.

Preferably, the sleeve has on its external surface ribs to facilitate a grip and to improve rigidity of the sleeve.

Preferably, the ejector is coupled by a screwed connection with the sleeve.

Preferably, the nozzle has on an external surface of its upper part ribs to facilitate a grip and to improve rigidity of the nozzle.

Preferably, the holder is made of a transparent plastic material.

The advantage of the nozzle assembly, following the invention, is that its structure provides not only a continuos pressure of the sealing means to the nozzle and to the plunger working part in PIPETTING, ADJUSTMENT or CALIBRATION MODES of the pipette, which continuos pressure is independent on a type of a detachable coupling between the nozzle and the holder, but also causes automatic sliding the sealing means outside the holder in the course of MAINTENANCE MODE. Thereby the occurrence of a disadvantageous phenomenon of the sealing means remaining deep inside the holder in MAINTENANCE MODE of the pipette has been eliminated. The mentioned phenomenon being present in the known nozzle assemblies precludes easy and undisturbed maintenance of the sealing means. In the effect, in the nozzle assembly according to the invention, the danger of a loss of leakproofness of the plunger working part relative to the nozzle as a result of unintentional incorrect mounting the nozzle in the holder or as a result of the nozzle slackening in the course of the pipette operating has been eliminated. On the other hand, in MAINTENANCE MODE of the pipette, an user has a very easy access to the sealing means which automatically slide outwards from the nozzle assembly holder and disassembly of the whole nozzle assembly has not to be made.

What is the next advantage of the nozzle assembly, following the invention, that it also provides an adjustment of a pressure force of the sealing means to the nozzle by the adjustment of a force generated by the pressure sub-assembly.

The next advantage of the present invention is that it enables application of the sealing means of many types to seal the plunger working part in the nozzle.

The pipette reliability has been improved by eliminating a risk of a damage by the user or by the serviceman of individual structure elements of the nozzle assembly, which are material to a correct pipette operation.

The special advantage of the nozzle assembly, following the present invention, is that it provides a possibility of a continuos observation of all its structure elements and their mutual configuration in the course of disassembly and assembly of the nozzle in MAINTENANCE MODE due to the application of the holder made of the transparent plastic material.

From a technological point of view, a feature that is especially advantageous is a significant shortening of cores needed for making an aperture through the nozzle during the technological manufacture process in comparison with the traditional, several times longer, one-piece nozzle of the known nozzle assemblies.

The application of the two-piece nozzle assembly enables, in turn, the application of a much cheaper plastic material for the holder and a better expensive plastic material for the nozzle, which nozzle material has to fulfil high dimensional requirements while the pipette operation and have the required thermal and chemical resistance.

The further advantage of the invention is that in case of the nozzle breakage while an improper pipette utilization or while a pipette fall, a replacement of the nozzle is significantly more simple and cheaper than in the conventional one-piece nozzle. This is because it is not needed to convey any structure elements from the nozzle assembly to the new one and only to replace the damaged nozzle by the new one.

BRIEF DESCRIPTION OF DRAWINGS

The subject matter of the present invention in preferred but not limited embodiments is presented by way of a drawing documentation, in which.

BEST MODE OF CARRYING OUT THE INVENTION

Figures 3, 4:
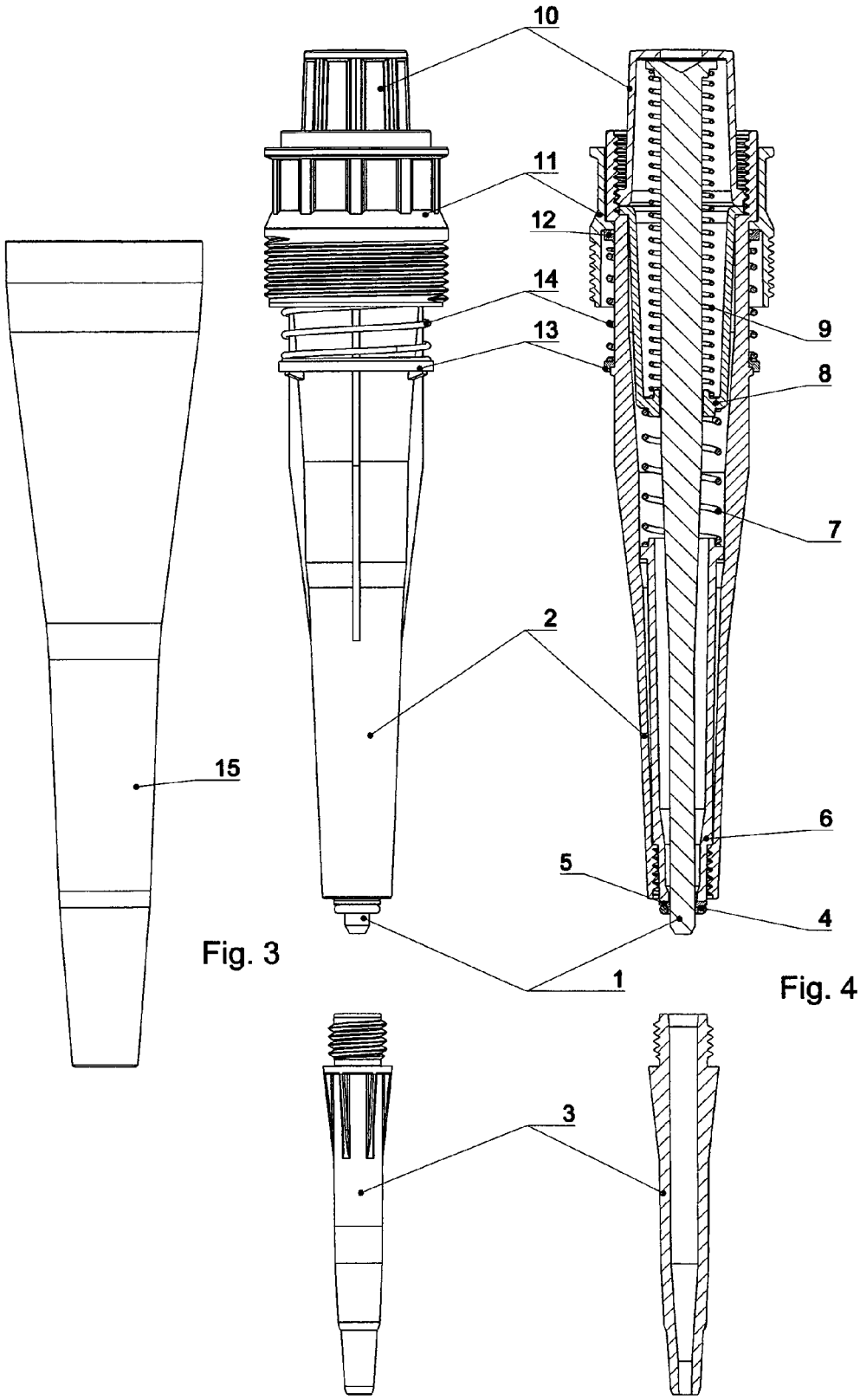
FIG. 3 presents, in general view, the nozzle assembly from FIG. 1 in MAINTENANCE MODE of the pipette.
FIG. 4 presents, in the longitudinal section, the nozzle assembly from FIG. 1 in MAINTENANCE MODE of the pipette.

The nozzle assembly for mounting in the mechanical or electronic pipette according to the present invention has a compact construction and after its disassembly from a handle 16 of the mechanical or electronic pipette the nozzle assembly constitutes a separate autonomous mechanical assembly, as shown in FIG. 3.

Figure 5:
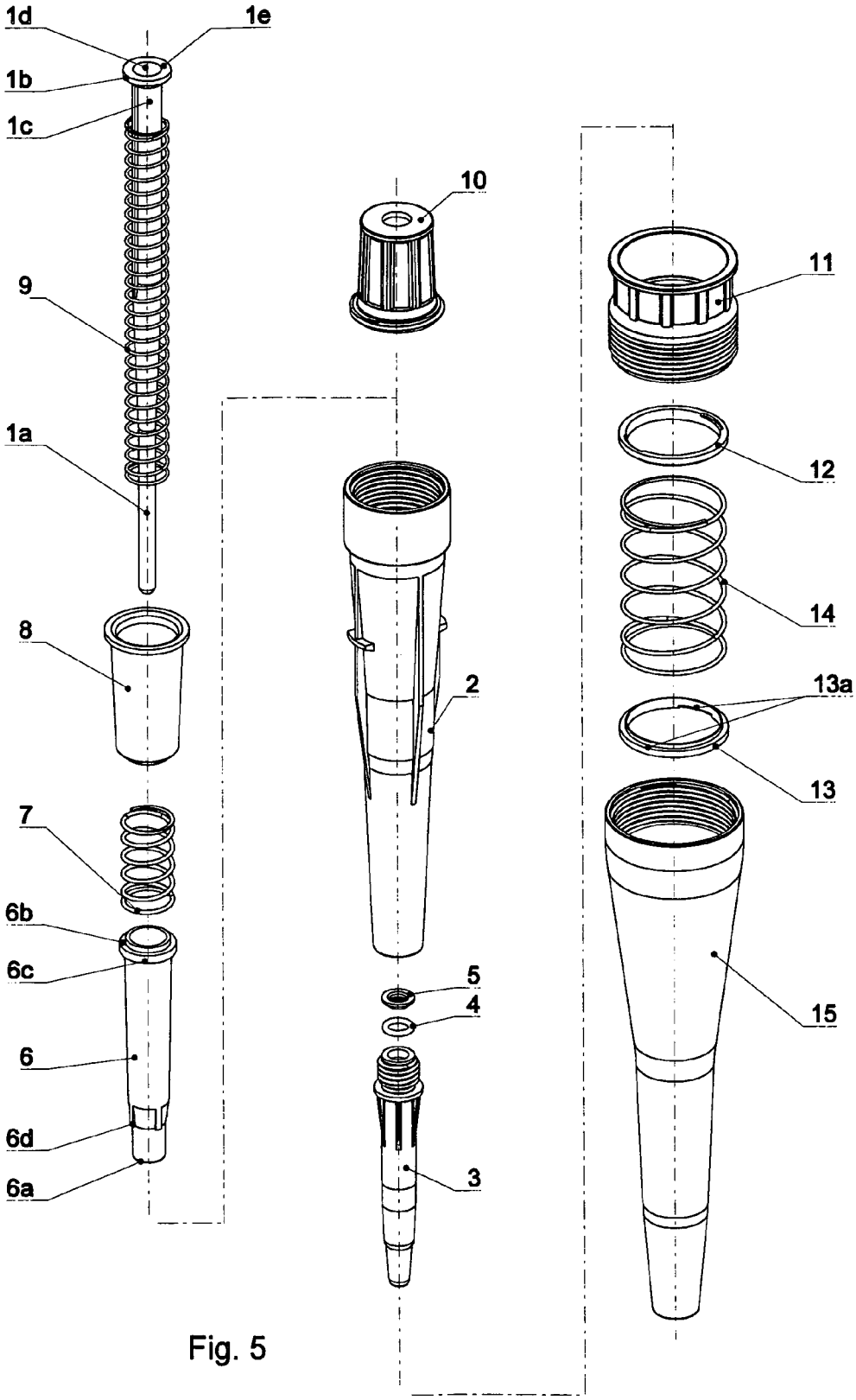
FIG. 5 presents, in the "exploded" perspective view, the nozzle assembly from FIG. 1 for mounting in the mechanical pipette.

The nozzle assembly shown in FIG. 4 comprises a two-piece body consisting of a nozzle 3 and of a holder 2, a plunger 1 cooperating via engaging means with a pipetting rod 18 of a drawing up and discharging mechanism arranged in a handle 16 of the pipette, and sealing means for sealing the plunger 1 in the nozzle assembly, whereas the sealing means are in the form of, preferably, a gasket 5 and a sealing ring 4, see FIG. 5. The nozzle 3 in its lower part is formed respectively for receiving pipette exchangeable tips 19 and in its upper part is coupled by a screwed connection with the holder 2. In the holder 2 a pressure sleeve 6 is slidably borne. The pressure sleeve 6 is via a pressure sub-assembly mounted in the holder 2 pressed to the sealing means placed between the pressure sleeve 6 and the nozzle 3. The pressure sub-assembly comprises a pressure spring 7, a locking sleeve 8 and a cap 10 which is coupled by a thread connection with the holder 2. Onto the plunger 1 and between a flange 1*b* of the plunger 1 and the locking sleeve 8 of the pressure sub-assembly, a pipetting spring 9 is arranged for cooperation with the pipetting rod 18 of the drawing up and discharging mechanism of the mechanical pipette. The flange 1*b* of the plunger 1 abuts its upper surface 1*e* against an abutting surface 10*d* of the cap 10. The plunger 1 is slidably borne in the pressure sleeve 6 and in the pressure sub-assembly. The nozzle assembly has an ejection assembly of a pipette exchangeable tip ejection mechanism, which ejection assembly is mounted on the nozzle assembly body. The ejection assembly of the pipette exchangeable tip ejection mechanism comprises a sleeve 11, an upper washer 12 and a lower washer 13, a spring 14 and the ejector 15. The sleeve 11 is slidably borne onto the holder 2. Onto the holder 2 between and by means of the upper washer 12 and the lower washer 13 the spring 14 of the ejector 15 is seated. The ejector 15 is coupled by a screwed connection with the sleeve 11.

PIPETTING MODE of the Pipette

Figure 1:
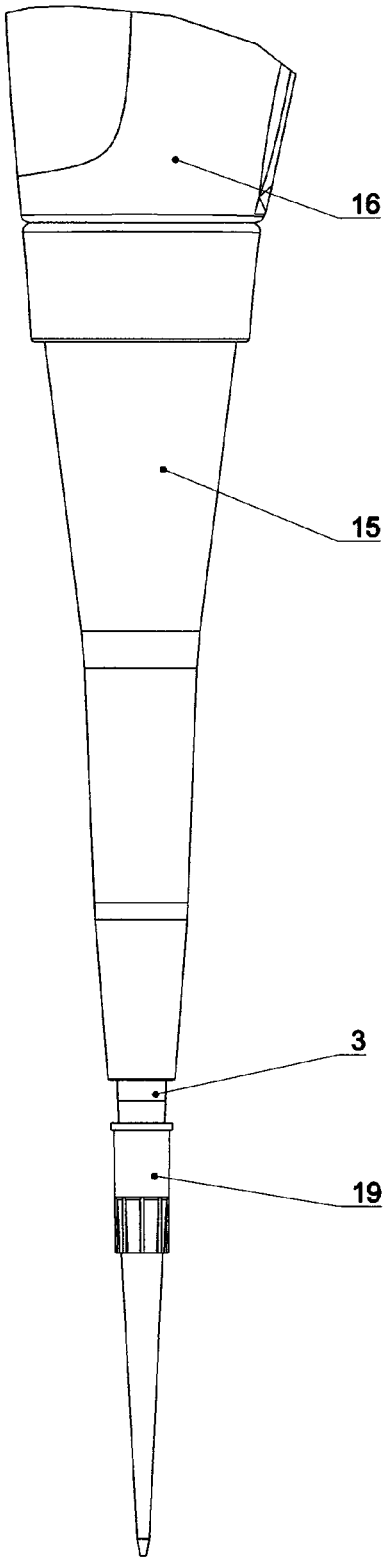
FIG. 1 presents, in general view, the nozzle assembly according to the present invention, which is mounted in the mechanical pipette.
Figure 2:
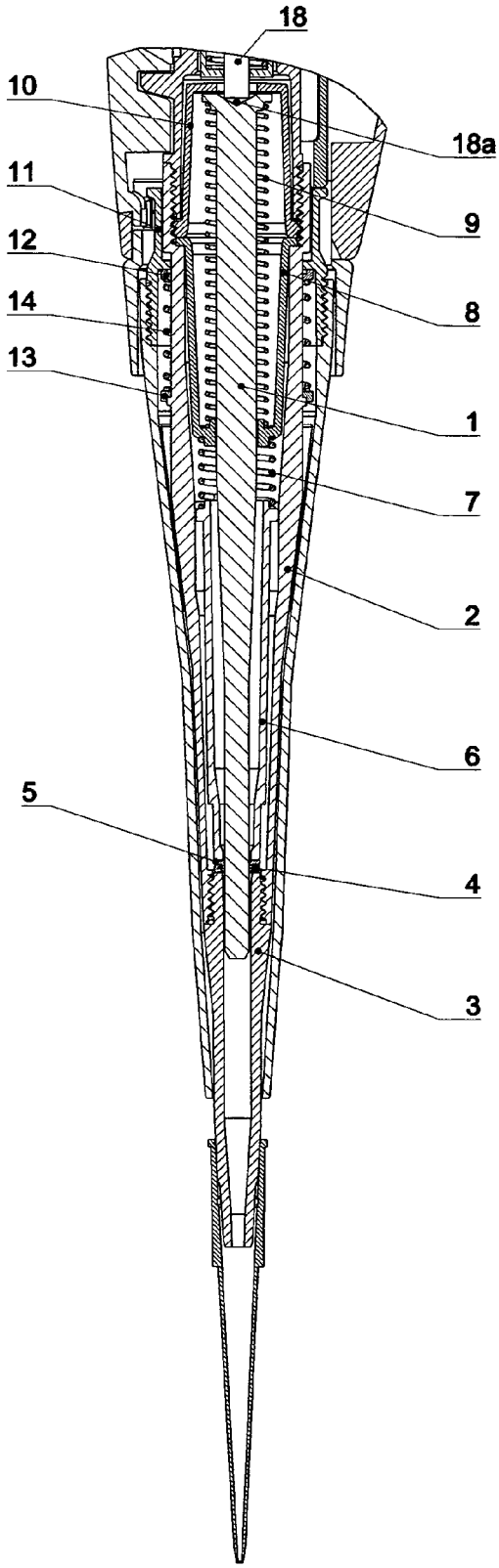
FIG. 2 presents, in the longitudinal section, the nozzle assembly from FIG. 1.
Figure 7:
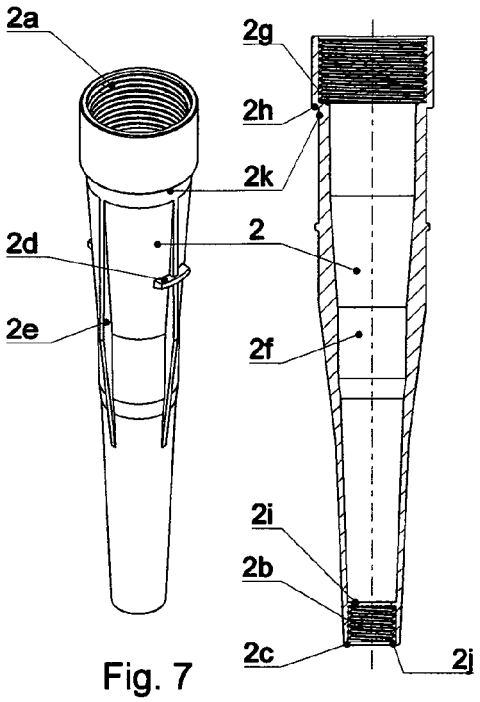
FIG. 7 presents, in the perspective view and in the longitudinal section, a holder 2 of the nozzle assembly according the invention.
Figure 10:
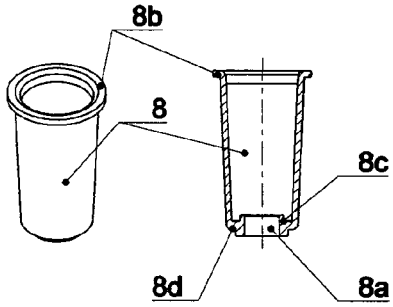
FIG. 10 presents, in the perspective view and in the longitudinal section, a locking sleeve 8 of the pressure sub-assembly of the nozzle assembly according to the invention.
Figure 11:
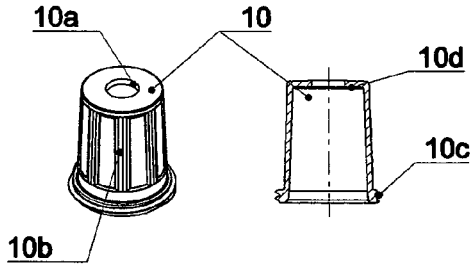
FIG. 11 presents, in the perspective view and in the longitudinal section, a cap 10 of the pressure sub-assembly of the nozzle assembly according to the invention.

After releasable mounting the nozzle assembly according to the invention in the handle 16 of the mechanical pipette, preferably, by means of the screwed connection which one of cooperating parts is an upper internal thread 2*a* of the holder 2 of the nozzle assembly, as shown in FIGS. 2 and 7, the pipetting rod 18 of the pipette drawing up and discharging mechanism placed in the pipette handle 16, as shown in FIGS. 2, 4 and 5, in PIPETTING MODE presses with its spherical lower end 18*a* and through an opening 10*a* in the cap 10, as shown in FIG. 11, onto a conical seat 1*d* of the plunger 1, as shown in FIG. 5. In PIPETTING MODE, under the influence of the force exerted by the user on a pipetting push-button (not shown) of the mechanical pipette, the plunger 1 presses with its flange 1*b* onto the pipetting spring 9 causing its compression and is moved downwards deep inside the nozzle assembly. The plunger 1 is slidably borne by means of a cylindrical surface 1*c* in an opening 8*a* of the locking sleeve 8 of the pressure sub-assembly, as shown in FIGS. 2, 4 and 10. Due to the application of the sealing means between the plunger 1 and the other structure elements of the nozzle assembly, a cylindrical working part 1*a* of the plunger 1 during longitudinal movements of the plunger 1 in PIPETTING MODE moves relative to the sealing means with retaining complete leakproofness between the cooperating structure elements of the nozzle assembly according to the invention in this constructional junction, as shown in FIGS. 2, 4 and 5.

Figure 12:
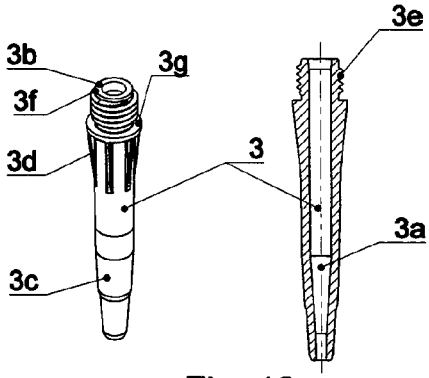
FIG. 12 presents, in the perspective view and in the longitudinal section, a nozzle 3 of the nozzle assembly according to the invention.

The plunger 1 which moves deep inside the nozzle assembly in PIPETTING MODE causes that an air is pushed out from a hole 3*a* of the nozzle 3, on a lower part of which the exchangeable tips 19 are seated for drawing up set values of liquid volumes, as best shown in FIGS. 2 and 12. A diameter of the working part 1*a* of the plunger 1 is selected in such a manner that at the set working stroke of the pipetting rod 18 of the pipette, it is possible to aspirate into the exchangeable tip 19 the precisely determined volume value of the liquid.

Under an action of the pipetting spring 9, which is pressed during the downward movement of the plunger 1, and after termination of a thrust applied by the user onto the pipetting push-button 17 (not shown) of the drawing up and discharging mechanism, it is possible as a result of a suction to aspire the desired volume value of the liquid into the exchangeable tip 19 that is seated with an interference on a sealing surface 3*c* of the nozzle 3.

However, for retaining the leakproofness condition of the cylindrical working part 1*a* of the plunger 1 in relation to the remaining structure elements of the nozzle assembly and independently on operational conditions of the pipette, it is necessary to provide a continuos pressure of the sealing means to the nozzle 3. With this aim, the pressure sleeve 6 is used, which is best shown in FIGS. 2, 4 and 5, and which pressure sleeve 6 presses the sealing means, for example, a gasket 5 and a sealing ring 4, to an upper abutting surface 3*b* of the nozzle 3, see FIG. 12. The continuos pressure of the pressure sleeve 6, the sealing means and the upper abutting surface 3*b* of the nozzle 3 is provided by the pressure spring 7 of the pressure sub-assembly, which acts onto an upper surface 6*b* of a flange 6*c* of the pressure sleeve 6. The pressure spring 7 at the top is rested onto a lower flange 8*d* of the locking sleeve 8 which in turn is seated in the holder 2 of the nozzle assembly by means of its upper flange 8*b*, as best shown in FIGS. 2, 4, 5 and 10. Such a structure of the pressure sub-assembly provides a regulation of the pressure force of the sealing means to the upper abutting surface 3*b* of the nozzle 3 as a result of a change of working characteristics of the pressure spring 7 of the pressure sub-assembly. The locking sleeve 8 constitutes also via its inner flange 8*c* a rest for a lower end of the pipetting spring 9, see FIGS. 4 and 10. For mounting the locking sleeve 8 inside the holder 2 of the nozzle assembly, the cap 10 is used, as best shown in FIG. 11. The cap 10 on its circumference is provided with an external thread 10*c* which cooperates with an upper internal thread 2*a* of the nozzle assembly holder 2. Screwing in and screwing out the cap 10 from the holder 2 is facilitated due to a presence of longitudinal ribs 10*b* formed on its external surface. Moreover, the cap 10 protects the plunger 1 against sliding out from the nozzle assembly under the influence of an initial tension of the pipetting spring 9. The upper surface 1*e* of the plunger 1 under the influence of the initial tension of the pipetting spring 9 is pressed to an abutting surface 10*d* of the cap 10, as shown in FIGS. 4 and 11.

Figure 6:
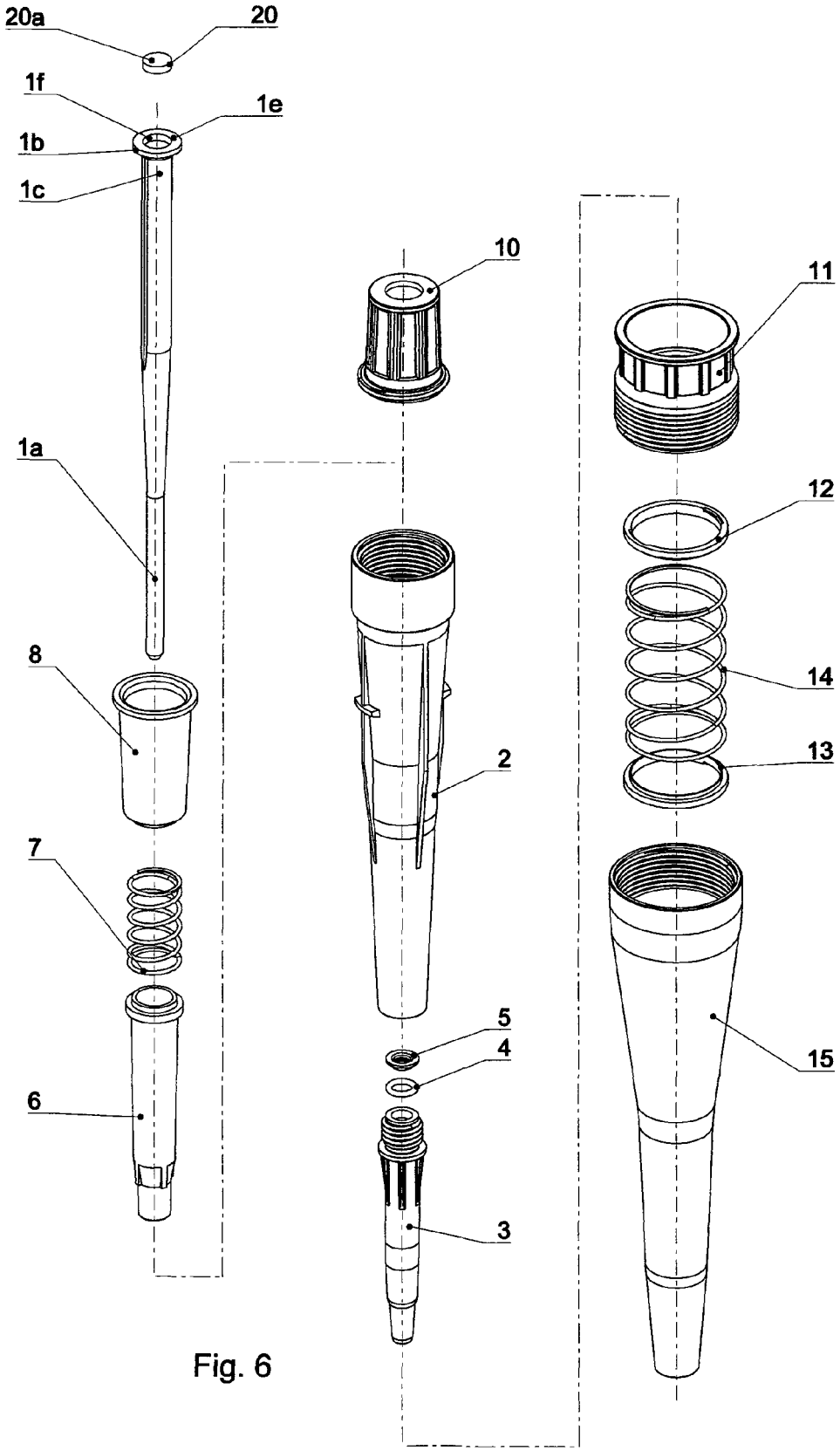
FIG. 6 presents, in the "exploded" perspective view, the nozzle assembly according the invention for mounting in the electronic pipette.

PIPETTING MODE with the nozzle assembly, according to the present invention, mounted in the electronic pipette differs from PIPETTING MODE in the mechanical pipette in a manner of driving the plunger 1 only and exclusively. In the nozzle assembly, according to the present invention, cooperating with the electronic pipette, as shown in FIG. 6, there is no need for use the pipetting spring 9 which is present in the nozzle assembly cooperating with the mechanical pipette. This is because the movement of the plunger 1 both during pushing up the air and during aspiration of the required volume value of the liquid is realized by means of a stepper motor. Therefore, the nozzle assembly used in the electronic pipette is not provided with the pipetting spring 9. Whereas, in order to provide a double-sided engagement of the nozzle assembly plunger 1 with a shaft of the stepper motor for driving the plunger 1, it is indispensable to apply technical engagement means which enable easy disassembly of the nozzle assembly from the handle of the electronic pipette to perform the nozzle assembly maintenance or sterilization.

In the nozzle assembly according to the invention for cooperation with the electronic pipette, as shown for example in FIG. 6, there are applied, preferably, the technical engaging means in the form of a clutch comprising a permanent magnet, which is attached to the stepper motor shaft in the electronic pipette handle 16, and a permanent magnet in the nozzle assembly in the form of a permanent magnet plate 20 made of ferromagnetic material. The permanent magnet plate 20 is glued into a cylindrical recess if in the flange 1*b* of the plunger 1. The permanent magnet which is attached to the stepper motor shaft in the handle 16 of the electronic pipette, after mounting the nozzle assembly according to the invention in handle 16 of the electronic pipette couples with an upper surface 20*a* of the permanent magnet plate 20 arranged in the upper part of the plunger 1, as shown in FIG. 6.

MAINTENANCE MODE of the Pipette

Disassembly of the Nozzle Assembly

The nozzle assembly, according to the invention, cooperating with the mechanical pipette in MAINTENANCE MODE is shown in FIGS. 3 and 4.

MAINTENANCE MODE of the electronic pipette with the nozzle assembly according to the present invention is realized in the same manner as MAINTENANCE MODE of the mechanical pipette with the nozzle assembly according to the invention.

Figure 8:
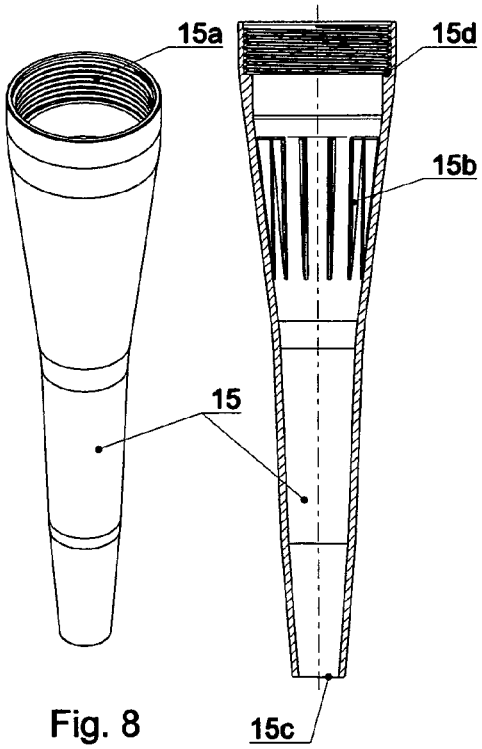
FIG. 8 presents, in the perspective view and in the longitudinal section, an ejector 15 of the ejection assembly of the exchangeable tip ejection mechanism, the ejector 15 cooperating with the nozzle assembly according to the invention.

In order to perform in MAINTENANCE MODE of the pipette an indispensable replacement of the sealing means, their cleaning or lubrication, it is necessary to disassemble of the nozzle assembly according to the invention by its screwing out from the handle 16 of the pipette, including the mechanical pipette, as shown in FIG. 2. Disassembly of the thread connection coupling the nozzle assembly with the handle 16 of the mechanical or electronic pipette is possible owing to an engagement of the nozzle assembly holder 2 with the ejector 15 by means of a set of cooperating longitudinal ribs. There are the longitudinal ribs 2*e* formed onto the external surface of the nozzle assembly holder 2, as shown in FIG. 7, which cooperate with the longitudinal ribs 15*b* formed onto the internal surface of the ejector 15, as shown in FIG. 8. As a result, in the course of turning the ejector 15, its rotational movement is transferred to the holder 2, and this, in turn, enables disassembly of the screwed connection between the nozzle assembly according to the invention and the pipette handle 16. One of cooperating parts of this screwed connection between the nozzle assembly and the pipette handle 16 is the upper internal thread 2*a* of the nozzle assembly holder 2.

Figure 9:
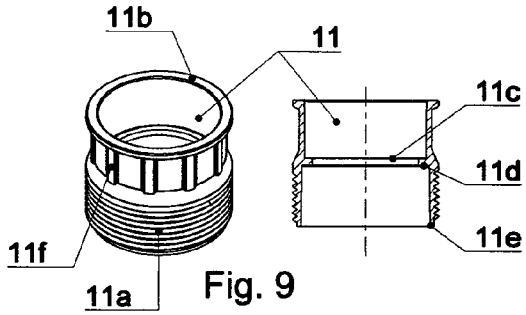
FIG. 9 presents, in the perspective view and in the longitudinal section, a sleeve 11 of the ejector 15 for cooperation with the nozzle assembly according to the invention.

After disassembly of the nozzle assembly from the handle 16 of the mechanical or electronic pipette, disassembly of the ejector 15 should be made, whereas the ejector 15 is elastically mounted on the holder 2 in order to provide an automatic return of the ejector 15 to its starting position when the exchangeable tip 19 is thrown off from the nozzle 3. This elastic mounting of the ejector 15 on the holder 2 is realized by means of the spring 14 of the ejector 15. The spring 14 is disposed between the upper washer 12 of the sleeve 11 of the ejector 15 and the lower washer 13 seated onto the nozzle assembly holder 2, as shown in FIGS. 5 and 6 which illustrate the nozzle assembly according to the invention for cooperation, respectively, with the mechanical pipette and with the electronic pipette. The upper washer 12 is used as a bearing element for the spring 14 so that during assembly or disassembly of the ejector 15 from the nozzle assembly, the spring 14 of the ejector 15 does not rotate. The upper washer 12 constituting the bearing element is placed between the spring 14 of the ejector 15 and the abutting surface 11*d* of the sleeve 11 of the ejector 15, as shown in FIG. 9. In order to support the spring 14 of the ejector 15, the lower washer 13 is seated onto fixing juts 2*d* of the holder 2 by means of its seating notches 13*a*, as shown in FIGS. 5, 6, 7 and 9. The sleeve 11 of the ejector 15 serves for fixation of the ejector 15 onto the holder 2 of the nozzle assembly according to the invention and is borne on a cylindrical surface 2*k* of the holder 2 and abuts by its inner flange 11*c* against an external abutting surface 2*h* of the holder 2. As shown in FIGS. 2 and 9, the sleeve 11 has also a contact surface 11*b* onto which acts a structure element of the ejection assembly of the pipette ejection mechanism, which is mounted in the handle 16 and which serves to actuate the ejector 15 that is to move the ejector 15 downwards along the holder 2 and the nozzle 3 for throwing of the exchangeable tips 19 from the nozzle 3 after PIPETTING MODE terminated. By turning the sleeve 11 of the ejector 15, the ejector 15 is caused to move downwards the nozzle assembly. Turning the sleeve 11 of the ejector 15 is facilitated by means of ribs 11*f* formed on the external surface of the sleeve 11. After complete turning out the external thread 11*a* of the sleeve 11 from the internal thread 15*a* of the ejector 15, the ejector 15 may be removed from the holder 2.

After disassembly of the ejector 15, the access to the upper part of the nozzle 3 is obtained. On the external surface of the nozzle upper part longitudinal ribs 3*d* are made. Ribs 3*d* facilitate screwing out the nozzle 3 from the nozzle assembly holder 2 and improve rigidity of the nozzle 3. After gripping the ribs 3*d*, the nozzle 3 may be separated from the holder 2 as a result of disassembly of a temporary fastening between the holder 2 and the nozzle 3. In the preferred embodiment of the nozzle assembly according to the invention, here presented, the nozzle 3 may be screwed out from the nozzle assembly holder 2 as a result of disassembly of the screwed connection between the holder 2 and the nozzle 3. This screwed connection consists of the external thread 3*e* on the external surface of the nozzle upper part 3 and the lower internal thread 2*b* on the internal surface of the lower part of the holder 2.

After disassembly of the nozzle 3, as a result of an action of the pressure spring 7 on the upper surface 6*b* of the flange 6*c* of the pressure sleeve 6 arranged in the holder 2 onto the working part 1*a* of the plunger 1, a forehead surface 6*a* of the pressure sleeve 6 is slided out downwards together with the sealing means abutted against the forehead surface 6*a* and from an abutting surface 2*c* of the holder 2. The gasket 5 and the sealing ring 4 are examples for the sealing means.

Due to this, in MAINTENANCE MODE, the sealing means are slided along the cylindrical working part 1*a* of the plunger 1 outwards the nozzle assembly holder 2, as shown in FIGS. 3 and 4. The downward movement of the pressure sleeve 6 under action of the pressure spring 7 of the pressure sub-assembly is limited by its ribs 6*d* which are placed on the external surface of the lower part of the pressure sleeve 6. During downward movement of the pressure sleeve 6 the ribs 6*d* come to the contact with a stop 2*i* formed on the internal surface of the lower part of the nozzle assembly holder 2, as shown in FIGS. 4 and 7. The pressure sleeve 6 is slidably borne in the holder 2 by means of the cylindrical flange 6*c* which cooperates with the internal surface 2*f* of the holder 2. Due to such a bearing, the pressure sleeve 6 is coaxially located in respect of the nozzle assembly holder 2 both in PIPETTING MODE or in MAINTENANCE MODE. After the complete downward movement of the pressure sleeve 6 under action of initial tension force of the pressure spring 7, that is in the position in which the ribs 6*d* of the pressure sleeve 6 are abutted against the stop 2*i* of the holder 2, the sealing means such as, preferably, the gasket 5 and the sealing ring 4 are slided outwards from the nozzle assembly holder 2, however, they still remain located on the cylindrical working part 1*a* of the plunger 1, as shown in FIG. 4. Such a location of the sealing means in the nozzle assembly according to the present invention in MAINTENANCE MODE of the mechanical or electronic pipette, after screwing out the nozzle 3 from the nozzle assembly holder 2, enables their easy replacement, cleaning or inspection.

After screwing out the nozzle 3 from the holder 2, it is possible to use the nozzle 3 as a pusher acting on a seat 1*d* of the plunger 1 in order to slide out the sealing means along the working part 1*a* of the plunger 1 far above the abutting surface 2*c* of the holder 2, which additionally facilitates their maintenance.

Assembly of the Nozzle Assembly

After performing indispensable maintenance activities in MAINTENANCE MODE of the pipette, assembly of the nozzle assembly according to the invention should be done in the following way.

In the first step, the nozzle 3 with its external thread 3*e* should be screwed into the lower internal thread 2*b* of the nozzle assembly holder 2. Screwing the nozzle 3 in the lower internal thread 2*b* of the holder 2 is facilitated due the application of a guiding conical portion 3*f* in the nozzle 3 and a guiding conical portion 2*j* in the holder 2, as shown in FIGS. 7 and 12. By pressing the nozzle 3 to the holder 2 with simultaneous screwing the nozzle 3 into the holder 2, the upward movement of the sealing means, such as, for example, the gasket 5 and the sealing ring 4, is caused as well as the movement of the pressure sleeve 6 deep inside the holder 2. Sliding the mentioned structure elements of the nozzle assembly according to the invention into the inside of the holder 2 causes compression of the pressure spring 7 of the pressure sub-assembly and thereby causes an increase of the pressure of the sealing means used against the upper abutting surface 3*b* of the nozzle 3. The nozzle 3 should be screwed into the holder 2 until the position in which the lower abutting surface 3*g* of the nozzle 3 comes into contact with the abutting surface 2*c* of the holder 2.

After screwing the nozzle 3 into the holder 2 of the nozzle assembly according to the invention, it is a cert that the pressure which derives from the tension force of the pressure spring 7 i.e. the pressure of the sealing means, such as, for example, the gasket 5 and the sealing ring 4, to and between the nozzle 3, the holder 2 and the external cylindrical surface of the working part 1*a* of the plunger 1 is sufficient to provide very good leakproofness of the plunger 1 in all operating conditions of the pipette for reliable functioning of the pipette in all operation modes of the pipette, and especially in PIPETTING, ADJUSTMENT and CALIBRATION MODES.

The next step is to slide the ejector 15 of the ejection assembly over the holder 2 with the nozzle 3 screwed in. While sliding over the ejector 15, the attention should be drawn to the longitudinal ribs 2*e* of the holder 2, which have to be disposed between the longitudinal ribs 15*b* of the ejector 15. When the ejector 15 comes close to the sleeve 11, the action of screwing the sleeve 11 into the internal thread 15*a* formed on the internal surface of the upper part of the ejector 15 should be initiated. The action of screwing the sleeve 11 in the ejector 15 should be performed till the position, in which the abutting surface 11*e* of the sleeve 11 comes into contact with the abutting surface 15*d* of the ejector 15, as shown in FIGS. 8 and 9. After screwing the sleeve 11 into the ejector 15, the nozzle assembly according to the invention can be mounted by means of the releasable connection in the handle 16 of the mechanical or electronic pipette, preferably after application of a small torque via a screwed connection which one of the cooperating parts is the upper internal thread 2*a* of the nozzle assembly holder 2, as shown in FIGS. 2 and 7.

The nozzle assembly according to the invention has the structure which in radical way facilitates to the user or to the serviceman the access to the sealing means of the plunger 1 in MAINTENANCE MODE of the pipette, which sealing means seal the plunger 1 in remaining operation modes. The access to the sealing means in MAINTENANCE MODE is important for carrying out cyclic necessary maintenance actions connected with the sealing means, for example their control, cleaning, replacement or lubrication. For having the direct access to the sealing means, the only actions which should be performed are—screwing the nozzle assembly out from the pipette handle 16, disassembling the ejector 15 from the nozzle assembly and screwing the nozzle 3 out from the holder 2. The sealing means under the action of the pressure sub-assembly automatically slide outwards from the holder 2. In such a manner, in MAINTENANCE MODE, a phenomenon of the sealing means remaining deep inside the holder 2, which precludes easy and undisturbed maintenance of the sealing means in the pipette with the conventional nozzle assemblies, has been eliminated.

The necessity of the complete disassembly of the nozzle assembly by the user to carry out the control, cleaning and lubrication of the sealing means has been eliminated. This significantly facilitates operation with the pipette provided with the nozzle assembly according to the invention and improves the pipette reliability by decrease the risk of damage of the individual structure elements of the nozzle assembly, which elements are crucial for correctness of the pipette operation.

Due to elimination of the necessity of disassembly of the plunger 1 in MAINTENANCE MODE of the pipette, the risk of its bending or damage has been excluded, wherein this risk is exceptionally high especially in case of the pipettes designed for aspiration the small volume values of the liquid.

Due to application of the nozzle assembly of the present structure, the pressure sub-assembly by its sleeve 6 guarantees the continuous pressure of the sealing means to the upper abutting surface 3*b* of the nozzle 3 and to the working part 1*a* of the plunger 1 in PIPETTING, ADJUSTMENT and CALIBRATION MODES of the pipette, wherein this continuous pressure is independent on the force of the releasable connection between the nozzle 3 and the holder 2. Thus, the danger of the loss of leakproofness of the working part 1*a* of the plunger 1 relative to the nozzle 3 has been eliminated. The mentioned danger occurs in the known nozzle assembly as a consequence of unintentional incorrect mounting the nozzle 3 in the nozzle assembly holder 2 or as a result of loosening the nozzle 3 in the course of operating with the pipette.

In the case when the nozzle 3 brakes during its improper utilization or during a fall of the pipette, its replacement with the new one is much more easier and cheaper in the present nozzle assembly that in case of the traditional one-piece nozzle because the transfer of any structure elements from the damaged nozzle assembly to the new one is not required and only the replacement of the damaged nozzle 3 by the new one.

In the present nozzle assembly, many different types of the technical sealing means which serve to achieve leakproofness between the working part 1*a* of the plunger 1 and the nozzle 3 can be applied.

The nozzle assembly according to the present invention can be applied with the nozzle of any nominal volume used in laboratories.

In the case when the holder 2 is made of transparent plastic material, there is a possibility to observe the structure elements of the nozzle assembly and their mutual configuration while disassembly or assembly of the nozzle 3 in MAINTENANCE MODE of the pipette.

On the basis of the above example embodiments of the invention, it is possible to provide its different changes, modifications and improvements, while such changes, modifications and improvements are obvious in the light of the idea of the invention and the attached hereto patent claims.

LIST OF STRUCTURE ELEMENTS

1. Plunger
1*a*. Working part
1*b*. Flange
1*c*. Cylindrical surface
1*d*. Seat
1*e*. Upper surface
1*f*. Recess
2. Holder (of the nozzle assembly)
2*a*. Upper internal thread
2*b*. Lower internal thread
2*c*. Abutting surface
2*d*. Fixing jut
2*e*. Rib
2*f*. Internal surface
2*g*. Internal abutting surface
2*h*. External abutting surface
2*i*. Stop
2*k*. Cylindrical surface
2*j*. Guiding conical portion
3. Pipette nozzle
3*a*. Hole
3*b*. Upper abutting surface
3*c*. Sealing surface
3*d*. Rib
3*e*. External thread
3*f*. Guiding conical portion
3*g*. Lower abutting surface
4. Sealing ring
5. Gasket
6. Pressure sleeve
6*a*. Forehead surface
6*b*. Upper surface
6*c*. Flange
6*d*. Rib
7. Pressure spring
8. Locking sleeve
8*a*. Opening
8*b*. Upper flange
8*c*. Inner flange
8*d*. Lower flange
9. Pipetting spring
10. Cap
10*a*. Opening
10*b*. Ribs
10*c*. External thread
10*d*. Abutting surface
11. Sleeve (of the ejector 15)
11*a*. External thread
11*b*. Contact surface
11*c*. Inner flange
11*d*. Abutting surface
11*e*. Abutting surface
11*f*. Ribs
12. Upper washer
13. Lower washer
13*a*. Seating notch
14. Spring (of the ejector 15)
15. Ejector
15*a*. Internal thread
15*b*. Rib
15*c*. Contact surface
15*d*. Abutting surface
16. Pipette handle
17. Push-button (not shown)
18. Pipetting rod
18*a*. Lower end
19. Pipette exchangeable tip
20. Permanent magnet plate
20*a*. Upper surface

I claim:

1. A nozzle assembly for mounting in a mechanical or an electronic pipette comprising:

a two-piece body consisting of a nozzle (3) and a holder (2);

a plunger (1) cooperating via engaging means with a pipetting rod (18) of a drawing up and discharging mechanism of the pipette, the drawing up and discharging mechanism being placed in a handle (16) of the pipette; and sealing means for sealing the plunger (1) in the nozzle assembly;

wherein the nozzle (3) is in its lower part shaped respectively for receiving a pipette exchangeable tip (19) and is in its upper part releasably connected with the holder (2);

characterized in that in the holder (2) the nozzle assembly has a pressure sleeve (6) slidably borne in the holder (2), which by a pressure sub-assembly seated in the holder (2) is pressed to the sealing means placed between the pressure sleeve (6) and the nozzle (3), wherein the plunger (1) is slidably borne in the pressure sleeve (6) and in the pressure sub-assembly, for ensuring leakproofness of the plunger (1) in the nozzle (3) in PIPETTING, ADJUSTMENT or CALIBRATION MODES of the pipette, wherein after releasing the nozzle (3) from the holder (2) in order to perform maintenance service of the pipette, the sealing means slide out automatically from an abutting surface (2*c*) of the holder (2) and remain located on the plunger (1), for facilitating the access to the sealing means in MAINTENANCE MODE of the pipette.

2. The nozzle assembly according to claim 1, characterized in that the pressure subassembly comprises a pressure spring (7), a locking sleeve (8) and a cap (10) which is releasably connected with the holder (2).

3. The nozzle assembly according to claim 2, characterized in that the cap (10) is coupled by a thread connection with the holder (2).

4. The nozzle assembly according to claim 2, characterized in that the cap (10) has on its external surface ribs (10*b*) formed to facilitate a grip and to improve its rigidity.

5. The nozzle assembly according to claim 1, characterized in that the nozzle (3) is in its upper part releasable connected by a screwed connection with the holder (2).

6. The nozzle assembly according to claim 1, characterized in that the sealing means comprise a gasket (5) and a sealing ring (4).

7. The nozzle assembly according to claim 1, characterized in that on the plunger (1) and in cooperation with the pressure sub-assembly a pipetting spring (9) is mounted for cooperation with the pipetting rod (18) of the drawing up and discharging mechanism of the mechanical pipette.

8. The nozzle assembly according to claim 7, characterized in that the pipetting spring (9) is mounted between a flange (1*b*) of the plunger (1) and the locking sleeve (8) of the pressure sub-assembly, wherein the flange (1*b*) of the plunger (1) abuts its upper surface (1*e*) against an abutting surface (10*d*) of the cap (10).

9. The nozzle assembly according to claim 1, characterized in that it has an ejection assembly of a pipette exchangeable tip ejection mechanism, whereas the ejection assembly is mounted on the nozzle assembly body.

10. The nozzle assembly according to claim 9, characterized in that the ejection assembly of the pipette exchangeable tip ejection mechanism comprises a sleeve (11), upper (12) and lower (13) washers, a spring (14) and an ejector (15), whereas the sleeve (11) is slidably borne on the holder (2) onto which between and by means of the upper (12) and lower (13) washers is seated the spring (14) of the ejector (15) which is releasably connected with the sleeve (11).

11. The nozzle assembly according to claim 10, characterized in that the sleeve (11) has on its external surface ribs (11*f*) for facilitating a grip and for improving rigidity of the sleeve (11).

12. The nozzle assembly according to claim 10, characterized in that the ejector (15) is coupled by a screwed connection with the sleeve (11).

13. The nozzle assembly according to claim 1, characterized in that the nozzle (3) on an external surface of its upper part has ribs (3*d*) for facilitating a grip and for improving rigidity of the nozzle (3).

14. The nozzle assembly according to claim 1, characterized in that the holder (2) is made of a transparent plastic material.

15. The nozzle assembly according to claim 1, characterized in that the downward movement of the pressure sleeve (6) is limited.

* * * * *